US005724078A

United States Patent [19]

Kotaki

[11] Patent Number: 5,724,078

[45] Date of Patent: Mar. 3, 1998

[54] INK JET APPARATUS WITH CONTROL OF RECORDING HEAD CLEANING

[75] Inventor: Yasuo Kotaki, Yokohama, Japan

[73] Assignee: Canon Kabushiki Kaisha, Tokyo, Japan

[21] Appl. No.: 767,155

[22] Filed: Dec. 16, 1996

Related U.S. Application Data

[63] Continuation of Ser. No. 45,172, Apr. 13, 1993, abandoned.

[30] Foreign Application Priority Data

Apr. 14, 1992 [JP] Japan ..... 4-120132

[51] Int. Cl.[6] ..... B41J 2/165

[52] U.S. Cl. ..... 347/33; 347/23

[58] Field of Search ..... 347/22, 23, 29, 347/30, 32, 33

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,849,769 | 7/1989 | Dressler | 347/27 |
| 4,926,196 | 5/1990 | Mizogushi et al. | 347/23 |
| 4,947,190 | 8/1990 | Mizusawa et al. | 347/33 |
| 4,951,066 | 8/1990 | Terasawa et al. | 347/30 |
| 4,959,673 | 9/1990 | Noda | 346/140 R |
| 4,977,459 | 12/1990 | Ebinuma et al. | 347/23 |
| 5,103,244 | 4/1992 | Gast et al. | 347/33 |
| 5,126,765 | 6/1992 | Nakamura | 347/33 |
| 5,138,343 | 8/1992 | Aichi et al. | 347/30 |
| 5,398,054 | 3/1995 | Fukazawa et al. | 347/23 |

FOREIGN PATENT DOCUMENTS

| | | | |
|---|---|---|---|
| 54-056847 | 5/1979 | Japan . | |
| 59-52660 | 3/1984 | Japan | 347/23 |
| 59-123670 | 7/1984 | Japan . | |
| 59-138461 | 8/1984 | Japan . | |
| 60-071260 | 6/1985 | Japan . | |
| 63-179751 | 7/1988 | Japan | 347/29 |
| 4-358846 | 12/1992 | Japan | 347/23 |

*Primary Examiner*—John E. Barlow, Jr.

*Attorney, Agent, or Firm*—Fitzpatrick, Cella, Harper & Scinto

[57] ABSTRACT

A method of recovery of the ink ejection capability of an ink jet printhead having a deteriorated discharge condition by changing a relative contact pressure between the cleaning member and the printhead. A first wiping is carried out using the cleaning member such that an ordinary load for cleaning is applied at 50–200 grams/line of discharge openings of the printhead. A second first wiping is carried out using the cleaning member such that an ordinary load for cleaning is applied at 200–500 grams/line of discharge openings of the printhead when initiated by an operator of the ink jet printing apparatus.

12 Claims, 11 Drawing Sheets

FIG.6

| RECOVERY MOVEMENT | NUMBER OF RECORDED RECORDING MEMBERS | NUMBER OF CONTACTS N | |
|---|---|---|---|
| | | LOW LOAD N1 | USUAL LOAD N2 |
| FIRST EMBODIMENT | ○ 50 → ○ 50 → ○ 50 → ○ 50 → ○ 50 → ○ 50 | 300 | 15 |
| SECOND EMBODIMENT | ○ 50 → ○ 50 → ○ 50 → ○ 50 → ○ 50 → ○ 50 | 600 | 5 |
| THIRD EMBODIMENT | ○ 50 → ○ 50 → ○ 50 → ○ 50 → ○ 50 → ○ 50 | 30000 | 1 |
| COMPARATIVE EXAMPLE | ○ 50 → ○ 50 → ○ 40 → △ 10 → ○ 30 → △ 20 → △ 50 → △ 20 → × 30 → × 50 | — | 100 |

0 5000 10000 15000 20000 25000 30000

INK JET APPARATUS WITH CONTROL OF RECORDING HEAD CLEANING

This application is continuation of application Ser. No. 08/045,172, filed Apr. 13, 1993, now abandoned.

BACKGROUND OF THE INVENTION

1. Field of the Invention

The present invention relates to an ink jet apparatus, and more particularly relates to an ink jet recording apparatus with which recording is carried out by discharging ink from a recording head to a recording medium.

2. Related Background Art

A recording apparatus records of images (images can include characters in this specification) according to image information (image information can include character information or the like in this specification) onto a recording medium such as a paper or a plastic thin film. These recording apparatuses can function as a printing machine, a copying machine, a facsimile machine and so on, or as output terminals of composite electric machines or work stations or the like having functions of a computer, a word processor and so on. These recording apparatuses can be characterized by their recording methods as an ink jet apparatus, a wire dot apparatus, a thermal printing apparatus, a laser beam apparatus and so on.

In a serial-type recording apparatus using a serial scanning method in which a main scanning is carried out in a main scan direction transverse to a sub-scan direction of conveyance of a recording medium, the recording of images is carried out by a recording means carried on a carriage which moves in the main scan direction along a recording medium after the recording medium is positioned at a predetermined recording region. After recording of one line is finished, a predetermined amount of conveyance of the recording medium in the sub-scan direction is carried out. Then recording of the next line on the stationary recording medium is carried out. The main scanning and the sub-scanning are to be repeated alternately. In this way, recording on the whole recording medium is carried out.

On the other hand, in a line-type recording apparatus, in which the only movement is the sub-scanning of a recording medium, recording of one line is carried out almost simultaneously after the recording member is positioned at a predetermined recording region. Then a predetermined amount of conveyance of the recording medium (a conveyance by pitch) is carried out. Subsequently, recording of the next line is carried out almost simultaneously. The one-line recording and the sub-scanning are to be repeated alternately. In this way, recording of the whole recording medium is carried out.

Among the foregoing recording apparatuses, an ink jet recording apparatus carries out recording by discharging ink from a recording means (a recording head) to a recording medium. This ink jet recording apparatus has many advantages. It is relatively easy to make the recording means compact. Images with a high density can be recorded rapidly. Recording on plain paper can be carried out without a special treatment to the paper. The running cost is relatively low. The recording can be carried out quietly because of a non-impact method. In addition, it is easy to carry out a color recording by using a plurality of color inks. Especially, a line-type ink jet recording apparatus with a full-multi type (full-line type) recording means which has a plurality of discharge openings extending over the width of a recording area of a paper can carry out recording more rapidly.

Particularly, an ink jet recording means (an ink jet recording head) utilizing thermal energy to discharge ink can be made more compact. One of the reasons for the compact design exists in the manufacture of the head. That is, a typical ink jet recording head with a high density of liquid paths (or discharge openings) can be made easily by providing members for forming walls of liquid paths, a top plate and so forth on a heater board member with electro-thermal converting bodies through semi-conductor manufacturing processes such as etching, depositing, sputtering or the like. On the other hand, there are demands for various capabilities of recording media. Recently, not only printing on usual recording media such as standard paper and plastic thin film (for example, overhead projector (OHP) film), but also printing on thin paper and processed paper (for example, paper with punched apertures for filing, perforated paper and irregularly shaped paper) has come into demand.

The ink jet recording apparatus carries out recording by discharging ink as a droplet from a discharge opening of a recording head to a recording medium. In an apparatus like this, in the case where extraneous matter from the ink or the recording medium adheres around the periphery of the discharge opening, a change of the discharging direction of the droplet from a proper discharging direction possibly occurs. Consequently, the droplet may miss the most suitable image contact position and the recording quality may deteriorate. As illustrated in FIG. 7, a plurality of discharge openings 76 are provided in a certain arrangement on the surface 75 of a recording head 74, which is positioned opposed to a recording medium which is not illustrated in the drawing. Extraneous matter 71 is adhered to a portion of the surface 75. In FIG. 7, numeral 77 designates a droplet discharged in the proper direction. Numerals 72A, 73A designate by a chain line preferred trajectories of flying droplets 72, 73 in the proper direction. Droplets 72, 73 are actually discharged in improper directions due to the adhesion of the extraneous matter 71 on a surface 75 of discharge openings 76.

In the ink jet recording apparatus of the related background art, a recovery apparatus is provided for eliminating deposits such as the extraneous matter 71 which cause the deterioration of the recording quality of images. This recovery apparatus has a cleaning member and wiping member for cleaning the surface of the discharge openings and a cap member for covering and closing tightly the discharge openings 76 from the atmosphere and for use in suction recovery.

FIGS. 8A and 8B are schematic partial plan views showing a structure and movements of the cleaning member 78 of a conventional recovery apparatus. Referring to FIG. 8A, there is shown a situation in which the recording head 74 is approaching the cleaning member 78 (in the direction of the arrow A). FIG. 8B illustrates a situation in which the recording head 74 contacts the cleaning member.

In the situation of FIG. 8A in which the recording head 74 approaches but does not contact the cleaning member 78, the surface 75 of the discharge openings and a top end of the cleaning member 78 extend to an overlapping location of an amount L. As illustrated in FIG. 8B, when the recording head 74 moves in the vicinity of the cleaning member 78, the surface 75 of the recording head contacts the cleaning member 78 and the cleaning of the surface 75 is carried out. The cleaning effect by the cleaning member 78 depends on a contact pressure (a load during the contact) by the cleaning member 78 which is dependent on the overlap amount L.

FIGS. 9A and 9B are schematic partial plan views showing a structure and movements of the cleaning member 78 of another recovery apparatus of the related background art. Referring to FIG. 9A, there is shown a situation in which the recording head 74 is approaching the cleaning member 78. FIG. 9B illustrates a situation in which the recording head 74 contacts the cleaning member 78. As illustrated in FIGS. 9A and 9B, a rear edge portion of a cleaning member 78 is supported by a holder 80 under pressure from a spring 79, and the cleaning member 78 can make a backward movement by the pressure from the surface 75 of the discharge openings. In other words, while the cleaning member 78 is fixed in FIGS. 8A and 8B, the load during the contact between the recording head 74 and the cleaning member 78 can be lightened by the elasticity of the spring 79 in FIGS. 9A and 9B.

In FIGS. 9A and 9B, an impact on the cleaning member 78 can be lightened by the effect of the spring 79. Therefore, damage of the surface of the cleaning member 78 can be decreased and the total durability of the cleaning member 78 can be improved. But on the other hand, the cleaning effect on the surface 75 of the discharge openings decreases. As described above with FIGS. 8A and 8B and FIGS. 9A and 9B, in the conventional recovery apparatus, the load during the contact between the cleaning member 78 and the surface 75 of the discharge openings has been designed in comparison of and in consideration of both the cleaning effect on the surface 75 and the durability of the cleaning member 78.

FIG. 10 is a schematic plan view showing an example of conditions around a discharge opening 76 to demonstrate ineffectiveness in a case where the conventional cleaning member 78 is used. FIGS. 11A to 11D are schematic section views across line XI—XI showing a change of conditions while a droplet is formed. As shown in FIGS. 10 and 11A to 11D, when the recording apparatus with the cleaning member 78 of the conventional recovery apparatus is used for a long time, residual ink adheres around the periphery of the discharge opening 76 even after the recovery operation and the ink which has not been eliminated completely increases in viscosity. Then the viscous ink strongly adheres as a thin film layer 81 around the periphery of the discharge opening 76.

This thin film layer 81 causes a change of an angle of contact between the periphery of the discharge opening 76 and the ink 82 in the vicinity of the discharge opening 76. As a result, a droplet 83 is drawn toward the thin film layer 81 during discharging. Thus, the discharging direction changes from that of the ideal situation. Therefore, the discharging direction of the droplet 83 changes to a direction at an angle θ with the ideal discharging direction to cause improper placement of the ink droplet on the recording medium and deterioration of the recording quality.

Even if the recovery is carried out when the thin film layer 81 is formed, the thin film layer 81 made of highly viscous ink cannot necessarily be eliminated completely. One reason for this is that the effectiveness of cleaning the periphery of the discharge opening 76 after a period of use decreases as compared with the cleaning effectiveness at the initial use because the highly viscous ink also adheres to the cleaning member 78.

On the other hand, if the cleaning is carried out under high contact load (high contact pressure) between the cleaning member 78 and the surface 75 of the discharge openings, it is possible to eliminate the thin film layer 81 made of highly viscous ink formed on the periphery of the discharge opening 76. But if the cleaning is always carried out under such high contact load from the initial use, the cleaning member will have to be replaced with a new one frequently because the surface of the cleaning member 78 will be easily damaged.

U.S. Pat. No. 4,959,673 relates to an ink jet recording apparatus that employs a serially moving recording head. The discharging surface of the recording head is wiped by a cleaning blade to remove any extraneous matter or residual ink. The contact force of the cleaning blade on the recording head varies depending on which direction the recording head is moving. When the recording head moves from the recording area toward a home position, the cleaning blade wipes the discharging surface with a relatively weak contact force. On the other hand, when the recording head is moved from the home position to the recording area, the cleaning blade wipes the discharging surface with a relatively high contact force. However, the contact pressure between the cleaning blade and the discharge surface is not changed in accordance with a discharging condition or a recording condition.

SUMMARY OF THE INVENTION

The present invention has been developed in consideration of the above situation. It is a object of the present invention to provide an improved ink jet apparatus, an improved recovery apparatus usable in an ink jet apparatus and an improved recovery method of an ink jet apparatus, each of which can overcome the problems described above.

It is another object of the present invention to provide an ink jet apparatus, a recovery apparatus usable in an ink jet apparatus and a recovery method of an ink jet apparatus, each of which can prevent the generation of the thin film layer made of highly viscous ink around the periphery of the discharge opening even if recording is carried out for a long time.

It is still another object of the present invention to provide an ink jet apparatus, a recovery apparatus usable in an ink jet apparatus and a recovery method of an ink jet apparatus, in each of which extraneous matter can be eliminated to effectively recover from conditions causing an undesired deterioration of recording quality, particularly in the case where the deterioration of the recording quality is due to adhesion of the extraneous matter around the periphery of the discharge opening.

According to one aspect of the present invention, an ink jet apparatus includes an ink jet head having a discharge surface provided with a discharge opening for discharging ink therethrough, a cleaning member for making contact with the discharge surface for cleaning the discharge surface upon a relative movement between the ink jet head and the cleaning member, and a changing device for changing a contact pressure between the cleaning member and the discharge surface in accordance with a discharging condition of ink discharging from the discharge opening.

According to another aspect of the present invention, a recovery apparatus usable in an ink jet apparatus includes a cleaning member, which makes contact with a discharge surface of an ink jet head provided with a discharge opening for discharging ink, the cleaning member for cleaning the discharge surface by a relative movement between the ink jet head and the cleaning member, and a changing device for changing a contact pressure between the cleaning member and the discharge surface in accordance with a discharging condition of ink discharging from the discharge opening.

Yet another aspect of the present invention includes a recovery method for an ink jet apparatus, which includes an ink jet head having a discharge surface provided with a discharge opening for discharging ink therethrough and a cleaning member that makes contact with the discharge surface for cleaning the discharge surface upon a relative movement between the ink jet head and the cleaning member. The recovery method includes the steps of effecting a first cleaning under a first contact pressure between the cleaning member and the discharge surface, and effecting a second cleaning under a second contact pressure, lower than the first contact pressure, between the cleaning member and the discharge surface in a case where a discharging condition of ink discharging from the discharge opening has deteriorated.

According to still another aspect of the present invention, an ink jet apparatus includes an ink jet head having a discharge surface provided with a discharge opening for discharging ink therethrough and onto a recording medium, a cleaning member for making contact with the discharge surface for cleaning the discharge surface upon a relative movement between the ink jet head and the cleaning member, and a changing device for changing a contact pressure between the cleaning member and the discharge surface in accordance with a recording condition of discharged ink recorded on the recording medium.

According to yet another aspect of the present invention, a recovery apparatus usable in an ink jet apparatus includes a cleaning member, which makes contact with a discharge surface of an ink jet head provided with a discharge opening for discharging ink onto a recording medium, the cleaning member for cleaning the discharge surface by a relative movement between the ink jet head and the cleaning member, and a changing device for changing a contact pressure between the cleaning member and the discharge surface in accordance with a recording condition of discharged ink recorded on the recording medium.

Still another aspect of the present invention, includes a recovery method for an ink jet apparatus, which includes an ink jet head having a discharge surface provided with a discharge opening for discharging ink therethrough and onto a recording medium and a cleaning member that makes contact with the discharge surface for cleaning the discharge surface upon a relative movement between the ink jet head and the cleaning member. The recovery method includes the steps of effecting a first cleaning under a first contact pressure between the cleaning member and the discharge surface, and effecting a second cleaning under a second contact pressure, lower than the first contact pressure, between the cleaning member and the discharge surface in a case when a recording condition of discharged ink recorded on the recording medium has deteriorated.

Other objects, features and advantages of this invention will become apparent from the following detailed description of the preferred embodiments of the present invention and the accompanying drawings.

BRIEF DESCRIPTION OF THE DRAWINGS

FIG. 6 is a table showing test results of recording quality, in the case of recovery using the first to the third embodiments of the present invention, and in the case of recovery using the conventional recording apparatus as a comparative example.

DESCRIPTION OF THE PREFERRED EMBODIMENTS

Figure 1:
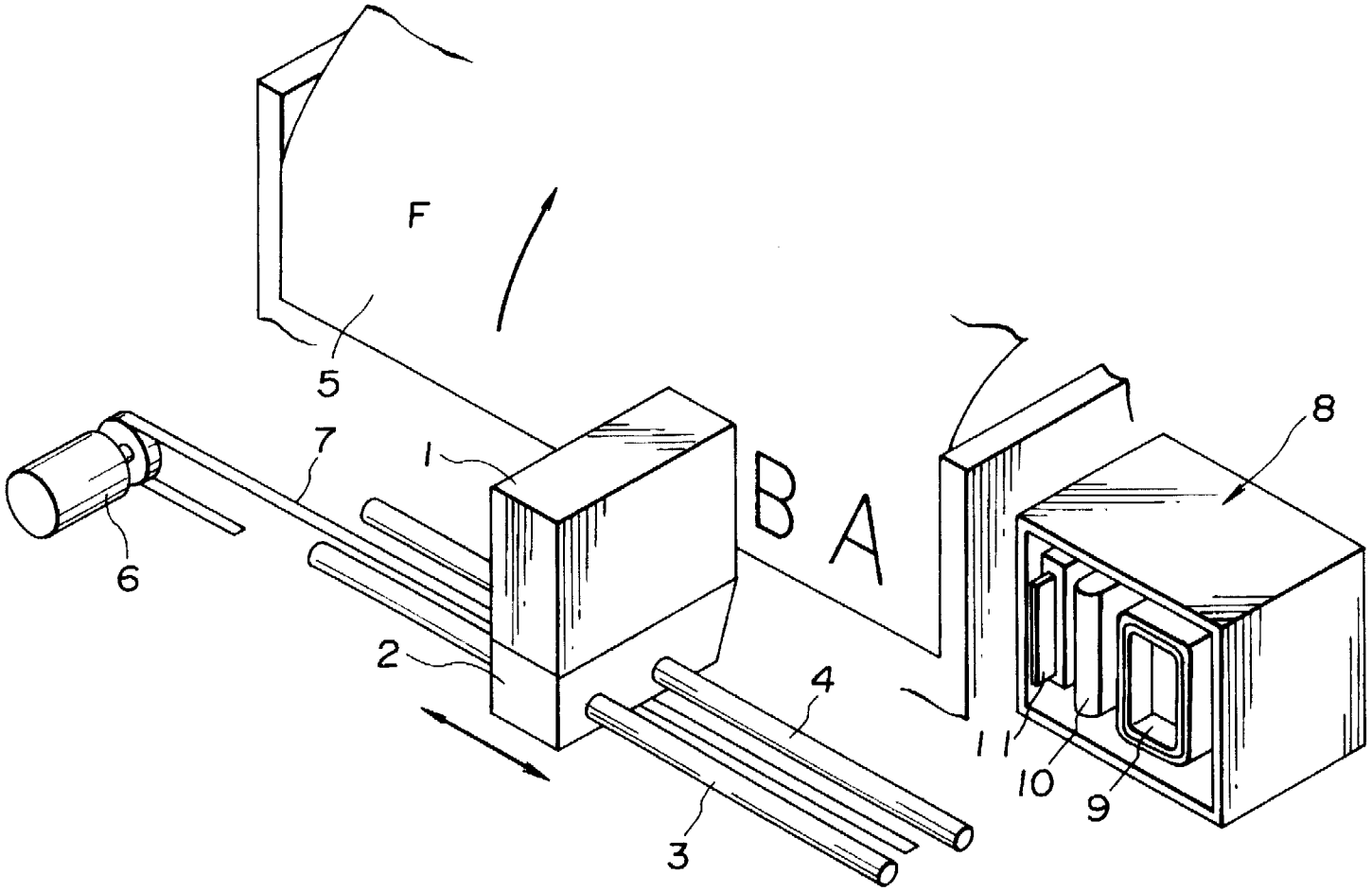
FIG. 1 is a schematic perspective view showing a structure of a main portion of an ink jet recording apparatus according to an embodiment of the present invention.

Referring now to FIGS. 1 to 6 and 12A to 12D, the preferred embodiments of the present invention will be described in detail. FIG. 1 is a schematic perspective view showing a structure of a main portion of an ink jet recording apparatus according to an embodiment of the present invention. As illustrated in FIG. 1, a recording means (a recording head) 1 is carried on a carriage 2, which is supported along two guide rails 3, 4 to move in a reciprocating manner. A recording medium 5 is conveyed in a sub-scanning direction transverse to the main scanning direction of movement of the carriage 2 (the direction of a movement of the recording head 1) through a recording area, which is in a range of the movement of the carriage 2. In the recording area, a predetermined gap (a flying distance of a droplet, for example 0.5 to 1.5 mm) is provided between a front surface (a discharge surface on which discharge openings are provided) of the recording head 1 and a recording surface of the recording medium 5.

The movement of the carriage 2 is carried out through a timing belt 7 by driving a carriage motor (a main scanning motor) 6 in either direction. Conveyance of the recording medium 5 is carried out by conveying rollers which are not illustrated in the drawing. Maintaining a position of the recording medium 5 in the recording area is carried out by guiding and supporting a reverse side of the recording medium on a platen (which is not illustrated in the drawing) or by maintaining a predetermined tension of the recording medium through pairs of conveying rollers disposed upstream and downstream of the recording area in the direction of the conveyance of the recording medium.

The recording of one line onto the recording medium is carried out by discharging ink from selected discharge openings in response to image signals in synchronism with the movement (main scanning) of the recording head 1 while movement of the recording medium 5, which is disposed in the recording area, is suspended. After recording of the one line, the conveyance (sub-scanning) of the recording member 5 for one line is carried out. Then the recording of the next line is carried out again as the recording head 1 moves (main scanning). The main scanning and the sub-scanning are to be repeated alternately. In this way, desired images are printed on the recording member 5.

A recovery apparatus 8 for maintaining and recovering a discharge capability of the recording head 1 is provided at a predetermined position which is in the range of the movement of the carriage 2 and is out of the recording area. This recovery apparatus has a cap member 9 for covering and closing tightly the discharge openings of the recording head 1 from the atmosphere, a cleaning member 10 for making contact with the surface of the discharge openings of the recording head 1 and for cleaning the surface, a auxiliary wiping member 11 for preliminary wiping the surface and for rubbing extraneous matter like viscous ink on the surface, a suction pump (which is not illustrated in the drawing) connected to the cap member 8 and for carrying out the suction recovery by exerting a suction force on the discharge openings when they are covered by the cap member 8, and so on.

The recording head (the recording means) 1 is provided with an electro-thermal converting body which generates thermal energy to be utilized to discharge ink. The recording is carried out by discharging ink as a droplet from a discharge opening according to growth and contraction of a bubble based on the film boiling generated by thermal energy from the electro-thermal converting body.

Figure 2:
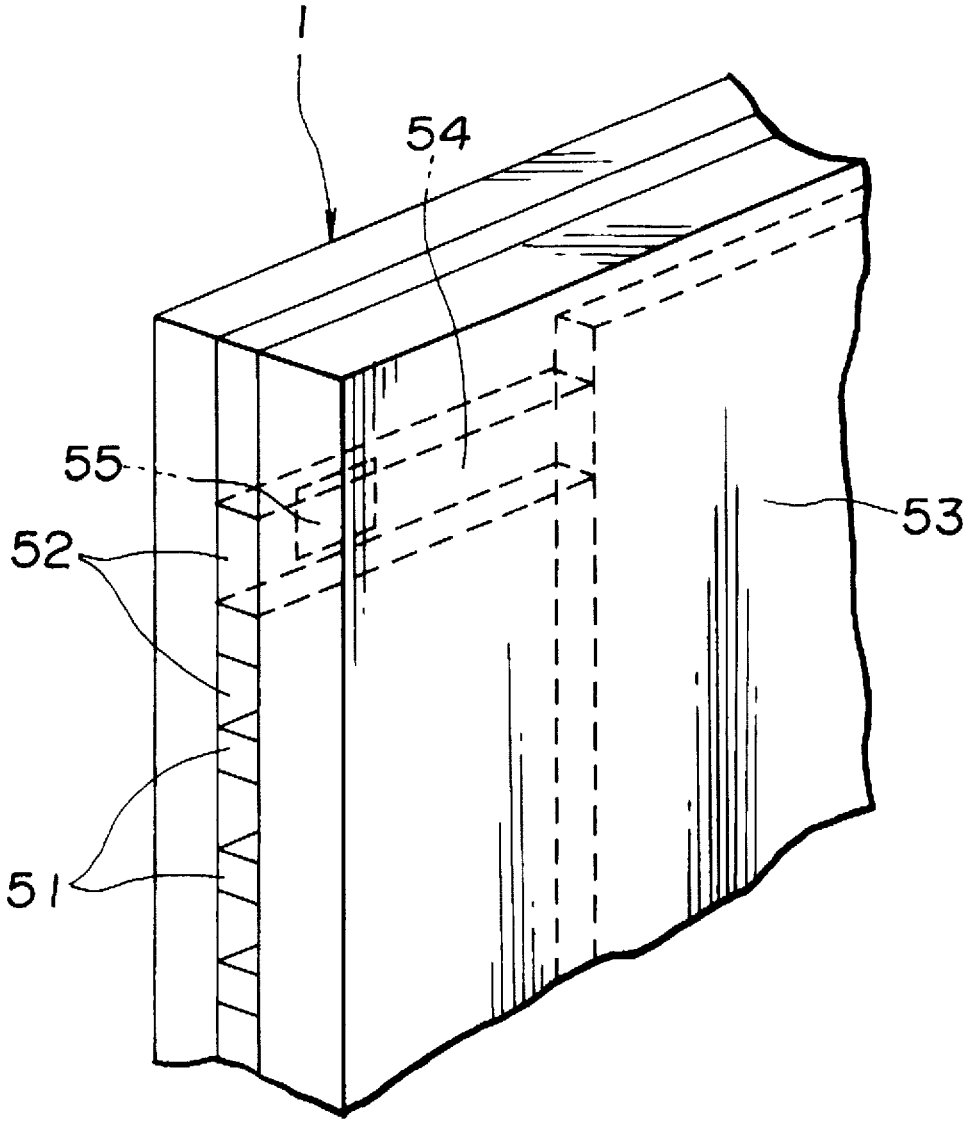
FIG. 2 is a schematic partial perspective view showing a structure of an ink discharging portion of the ink jet recording apparatus in FIG. 1.

FIG. 2 is a schematic partial perspective view showing a structure of an ink discharging portion of the ink jet recording head 1. As illustrated in FIG. 2, a plurality of discharge openings 52 are provided at a predetermined pitch on the discharge surface of the recording head 1 opposed to a recording surface of the recording medium 5 which leaves a predetermined gap (for example, about 0.5 to 2.0 mm) between the surfaces. A heat generating portion 55 of an electro-thermal converting body for generating thermal energy to be utilized to discharge the ink is provided on a wall of each liquid path 54 which communicates between a common liquid chamber 53 and each discharge opening 52. The ink jet recording head 1 is carried on the carriage 2 such that the discharge openings 52 are disposed in a line transverse to the direction of the movement of the carriage 2 (the direction of the main scanning). Ink is discharged as a droplet from a selected discharge opening 52 of the recording means (the recording head) 1 by driving the corresponding electro-thermal converting body 55 according to an image signal or a discharge signal to generate a bubble based on the film boiling in the corresponding liquid path 54.

FIGS. 3A to 3D are schematic partial plan views showing a structure and movements of a cleaning means of the recovery apparatus of the ink jet recording apparatus according to the first embodiment of this invention. As illustrated in FIGS. 3A to 3D, a rear edge portion of a cleaning member 10, which is made of a rubber-like elastic body (for example, a continuous body made from a polyurethane such as "RUBYCELL" (tradename) manufactured by Toyoh Polymer Co.), is supported by a holder 12 made of a rigid body material. A rear surface of the holder 12 is in contact with a peripheral surface (a cam surface) of a rotary cam 13. An overlap amount L between an end of the cleaning member 10 and the surface 51 of the discharge openings of the recording head 1 is determined by controlling a rotating position of the rotary cam 13 with a controller 18. In this way, a contact pressure (a contact load) between the cleaning member 10 and the recording head 1 during cleaning is controllable.

Figure 3A:
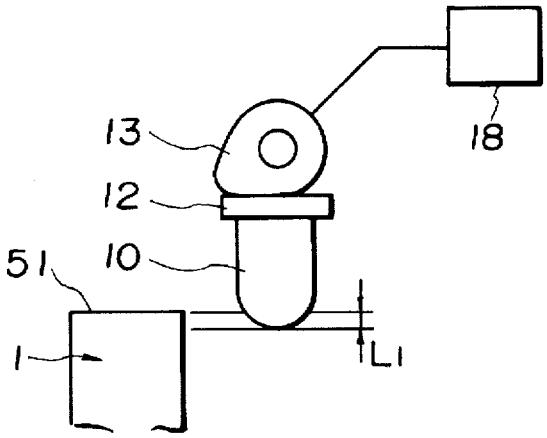
FIGS. 3A to 3D are schematic partial plan views showing a structure and movements of a cleaning means of the recovery apparatus of the ink jet recording apparatus according to a first embodiment of the present invention.
Figure 3B:
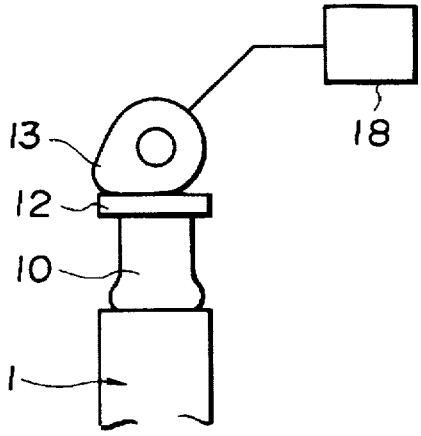

Referring to FIG. 3A, there is shown a situation in which the recording head 1 is approaching the cleaning member 10 to carry out the cleaning of the discharge surface 51 of the recording head 1 automatically after each time a preselected number of recording media are recorded upon or every preselected number of discharge signals to form droplets from the discharge openings 52 are supplied. In this situation, an overlap amount between an end of the cleaning member 10 and the discharge surface 51 of the recording head 1 is set to a relatively small distance, in this embodiment the smallest value $L_1$. Then, as illustrated in FIG. 3B, the discharge surface 51 of the recording head 1 contacts the cleaning member 10 with the smallest value $L_1$. In this way, the cleaning of the discharge surface 51 of the recording head 1 is carried out. The overlap amount $L_1$ is preselected such that the load on the discharge surface is not less than 50 g/line of discharge openings and less than 200 g/line of discharge openings.

Figure 3C:
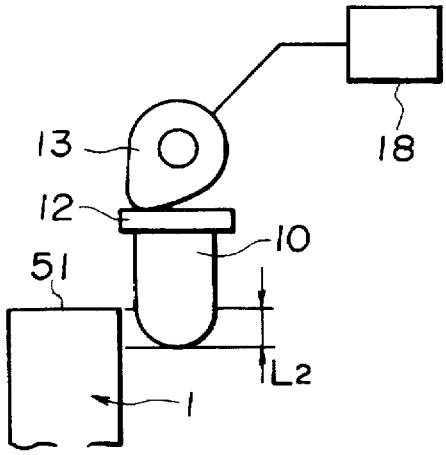
Figure 3D:
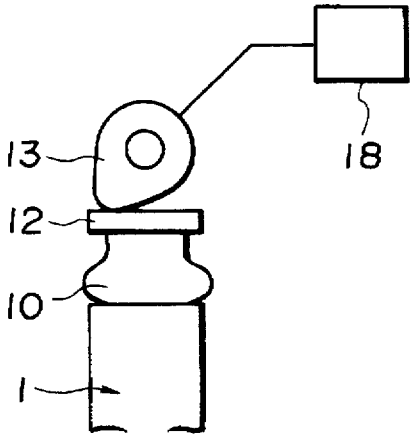
Figure 7:
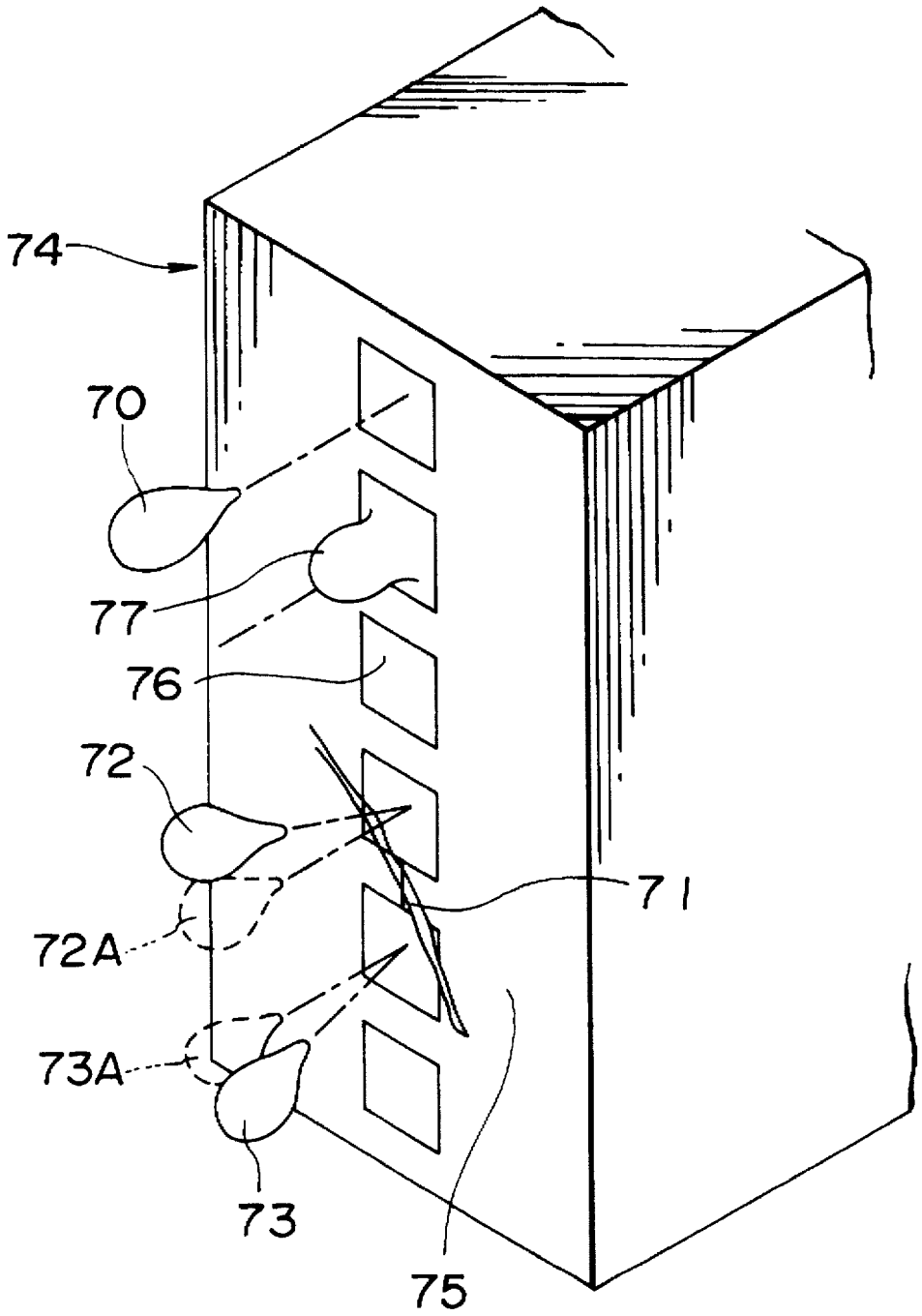
FIG. 7 is a schematic perspective view showing a droplet discharged in the proper direction and droplets discharged in the improper direction due to adhesion of extraneous matter on a surface of discharge opening.
Figure 8A:
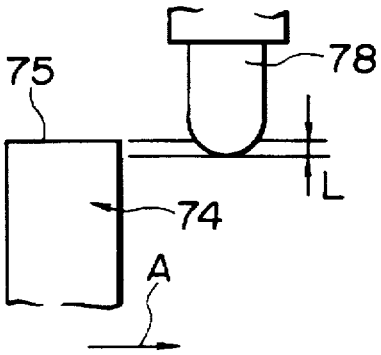
FIG.8(A) (PRIOR ART)
FIGS. 8A and 8B are schematic partial plan views showing a structure and movements of a cleaning member of the conventional recovery apparatus.
Figure 8B:
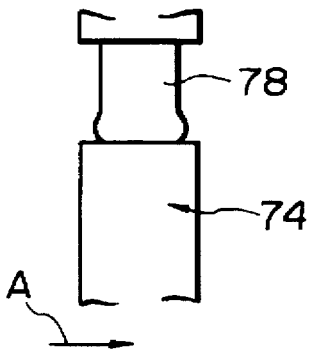
FIG.8(B) (PRIOR ART)
Figure 9A:
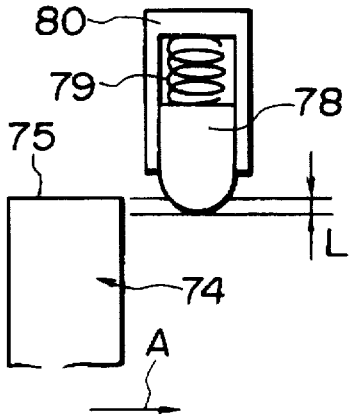
FIG.9(A) (PRIOR ART)
FIGS. 9A and 9B are schematic partial plan views showing a structure and movements of the cleaning member of another conventional recovery apparatus.
Figure 9B:
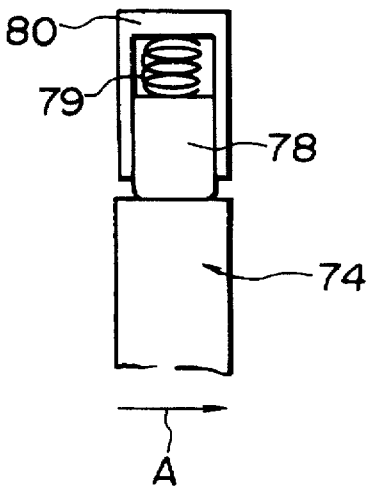
FIG.9(B) (PRIOR ART)

In case extraneous matter (for example, extraneous matter 71 in FIG. 7) adheres to the surface 51 of the discharge openings and consequently the deterioration of the recording quality occurs, the overlap amount L is increased from $L_1$ to $L_2$ by rotating the rotary cam 13 to advance the cleaning member 10 before the cleaning member 10 makes contact with the discharge surface 51 as illustrated in FIG. 3C. Then the cleaning of the discharge surface 51 is carried out by moving the recording head 1 while the cleaning member 10 is in contact with the surface 51 as illustrated in FIG. 3D. The overlap amount $L_2$ is preselected such that the load on the discharge surface is not less than 200 g/line of discharge openings and not more than 500 g/line of discharge openings.

In FIG. 3B, a contact load of the cleaning member 10 is relatively small and an impact upon contact is relatively low because the overlap amount is relatively small as compared with in FIG. 3D. Therefore, even if the cleaning of the discharge surface 51 is carried out automatically with the smaller overlap $L_1$ after recording every preselected number of recording media or after applying every preselected number of discharge signals, a durability of the cleaning member 10 is not adversely affected. And even if the number of cleanings of the discharge surface 51 per unit time is increased, a life of the cleaning member 10 is not adversely affected.

Figure 10:
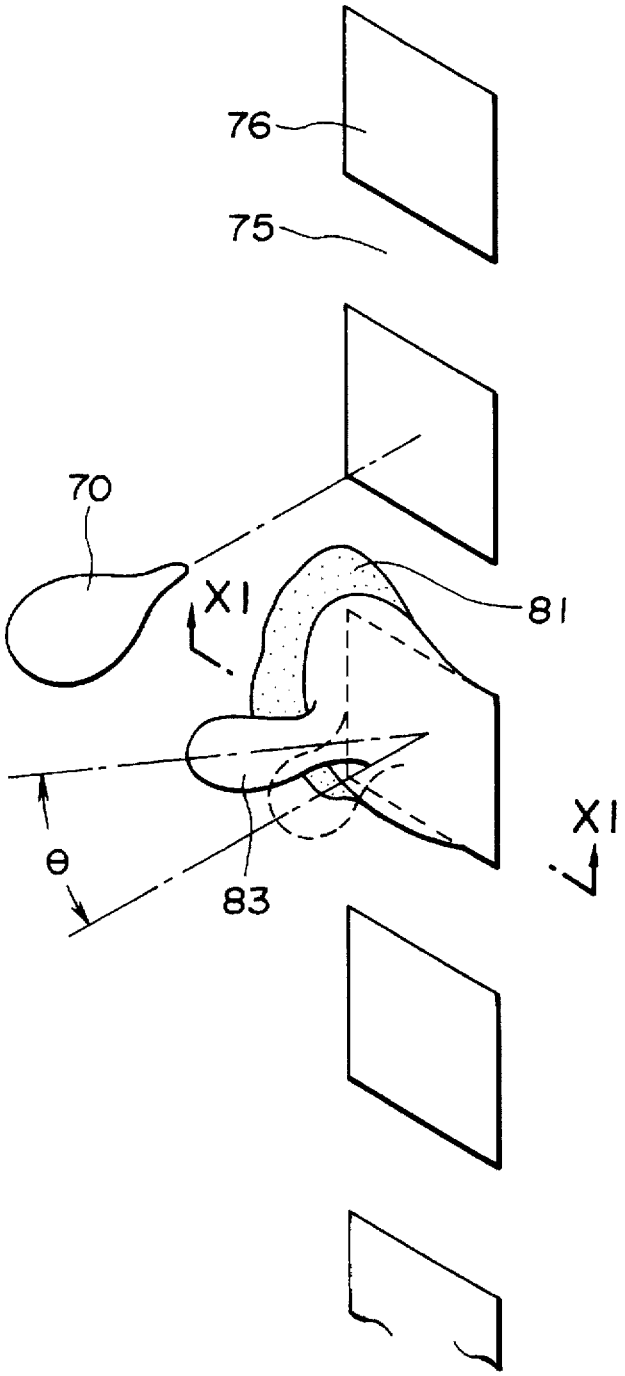
FIG. 10 (PRIOR ART)
FIG. 10 is a schematic plan view showing an example of conditions around a discharge opening in the case where a conventional cleaning member is used.
Figure 11A:
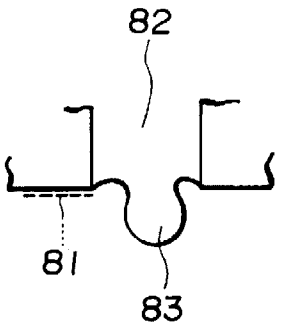
FIG.11(A) (PRIOR ART)
FIGS. 11A to 11D are schematic section views taken across line XI—XI in FIG. 10 showing a change of conditions while a droplet is formed.
Figure 11B:
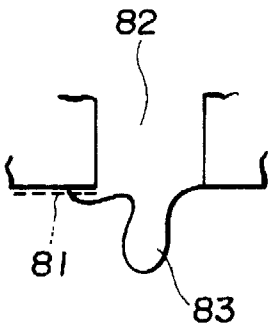
FIG.11(B) (PRIOR ART)
Figure 11C:
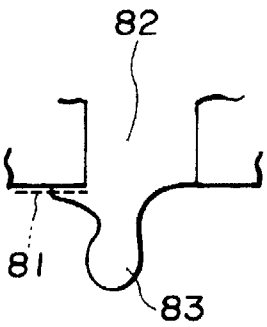
FIG.11(C) (PRIOR ART)
Figure 11D:
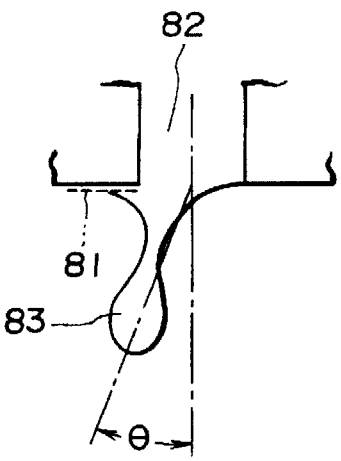
FIG.11(D) (PRIOR ART)
Figure 12A:
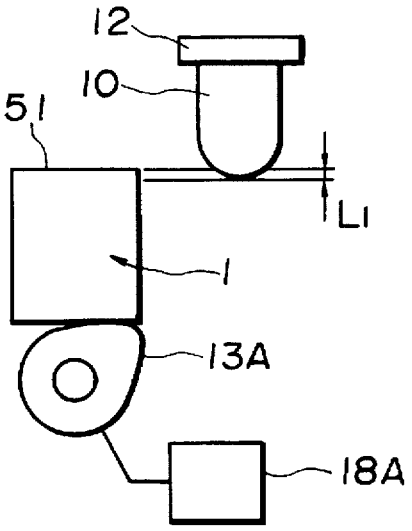
FIGS. 12A to 12D are schematic partial plan views showing a structure and movements of a cleaning means of the recovery apparatus of the ink jet recording apparatus according to a fourth embodiment of the present invention.
Figure 12B:
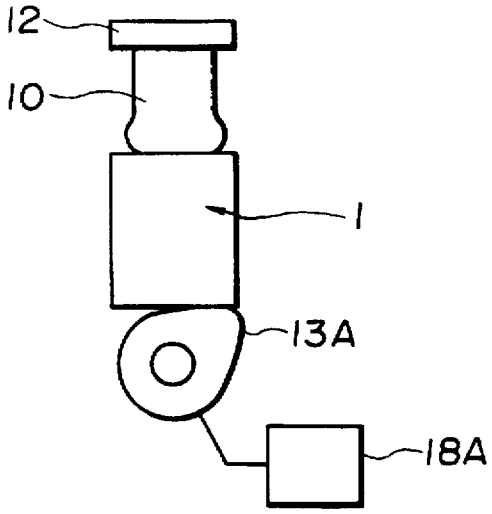
Figure 12C:
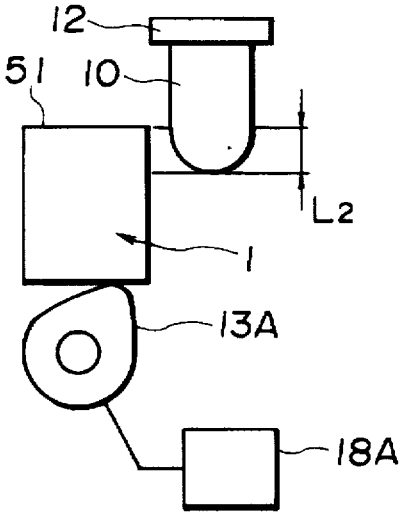
Figure 12D:
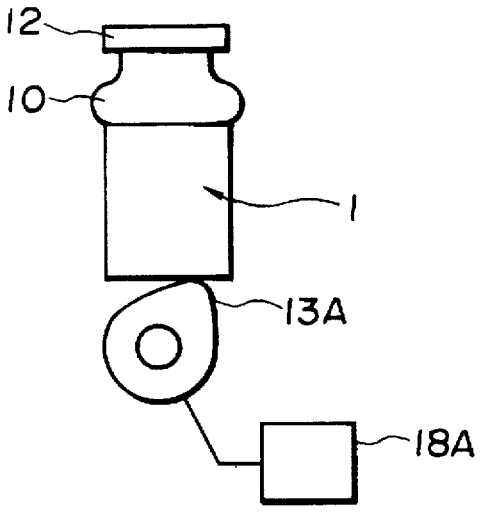

According to the embodiment illustrated in FIGS. 3A to 3D, a contact pressure between the cleaning member 10 and the discharge surface 51 of the recording head 1 is changeable, whereby it is possible to avoid an occurrence of a thin layer (for example, thin layer 81 in FIG. 10) of viscous ink forming around the periphery of the discharge openings 52 during a long period of recording. In addition, the number of usual recovery movements with the heavier load can be reduced, whereby a life of the cleaning member 10 can be improved remarkably.

FIGS. 4A to 4D are schematic partial plan views showing a structure and movements of a cleaning means of the recovery apparatus of the ink jet recording apparatus according to the second embodiment of this invention. As illustrated in FIGS. 4A to 4D, a rear edge portion of a cleaning member 10, which is made of a rubber-like elastic body, is supported by a holder 12 made of a rigid body. The holder 12 is connected with an arm 15, which can be driven to rotate by a controller 19 by switching a solenoid 14 between ON and OFF. In other words, an overlap amount L between an end of the cleaning member 10 and the discharge surface 51 of the recording head 1 is controlled by controlling the solenoid 14 instead of the rotary cam 13 in FIGS. 3A to 3D.

In this way, a contact pressure (a contact load) between the cleaning member and the recording head during cleaning is controlled.

Figure 4A:
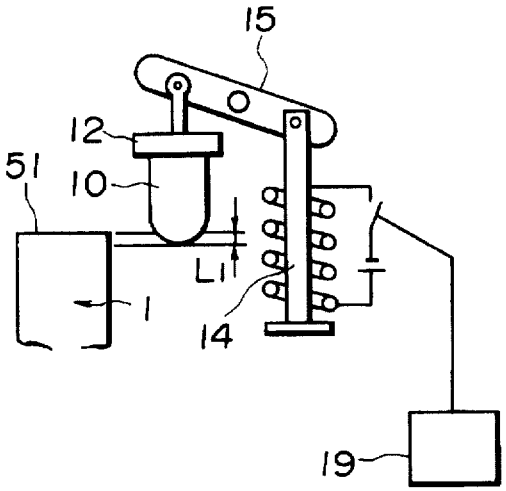
FIGS. 4A to 4D are schematic partial plan views showing a structure and movements of a cleaning means of the recovery apparatus of the ink jet recording apparatus according to a second embodiment of the present invention.
Figure 4B:
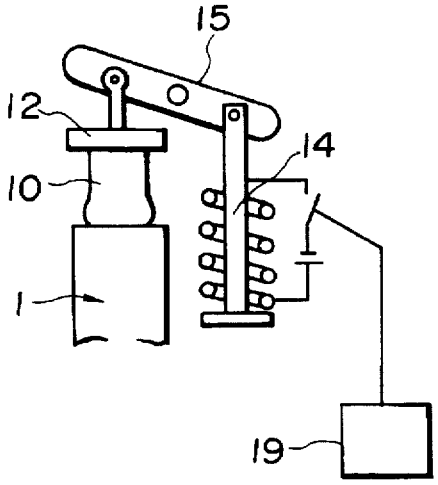

Referring to FIGS. 4A and 4B, there are shown situations in which the cleaning of the discharge surface 51 is carried out automatically after each time a preselected number of recording media are recorded upon or each time preselected number of discharge signals to form droplets from the discharge openings 52 are supplied. In these situations, the solenoid 14 is switched OFF, therefore an overlap amount between an end of the cleaning member 10 and the discharge surface 51 of the recording head 1 is set to a small value $L_1$. FIG. 4A illustrates a situation in which the recording head 1 is approaching the cleaning member 10. FIG. 4B illustrates a situation in which the discharge surface 51 contacts the cleaning member 10 and the cleaning of the discharge surface 51 is carried out.

Figure 4C:
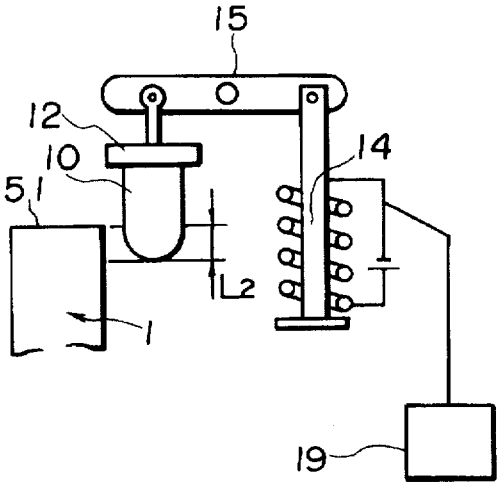
Figure 4D:
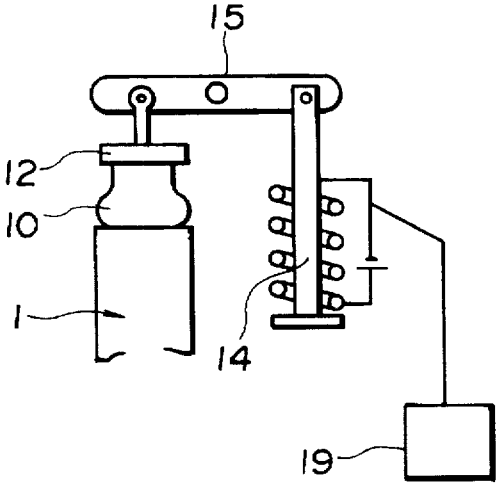

Referring to FIGS. 4C and 4D, there are shown situations in which extraneous matter (for example, extraneous matter 71 in FIG. 7) adheres to the surface 51 of the discharge openings and consequently deterioration of the recording quality occurs. In these situations, the solenoid 14 is switched ON and the cleaning member 10 is advanced by rotation of the arm 15. Therefore the lap amount L is set to a large value $L_2$. Consequently, the cleaning of the discharge surface 51 by the cleaning member 10 is carried out under a larger contact pressure than in the situations of the automatic cleaning. FIG. 4C illustrates a situation in which the recording head 1 is approaching the cleaning member 10. FIG. 4D illustrates a situation in which the discharge surface 51 contacts the cleaning member 10 and the cleaning of the surface 51 of the discharge openings is carried out.

Also in this embodiment, a contact load of the cleaning member 10 is relatively small and an impact upon the contact is relatively low because the overlap amount is relatively small in FIG. 4B as compared with that in FIG. 4D. Therefore, even if the cleaning of the surface 51 is carried out automatically after recording of every preselected number of recording media or after supplying every preselected number of discharge signals, a durability of the cleaning member 10 is not adversely affected. Even if the number of cleanings of the discharge surface 51 per unit time is increased, a life of the cleaning member 10 is not adversely affected. Therefore, also according to the second embodiment as illustrated in FIGS. 4A to 4D, similar effects can be achieved to in the case of the embodiment as illustrated in FIGS. 3A to 3D.

FIGS. 5A to 5D are schematic partial plan views showing a structure and movements of a cleaning means of the recovery apparatus of the ink jet recording apparatus according to the third embodiment of this invention. As illustrated in FIGS. 5A to 5D, a rear edge portion of a cleaning member 10, which is made of a rubber-like elastic body, is supported by a holder 12 made of a rigid body. The holder 12 is connected with a shape memory alloy 16, which can be heated by switching a heat source 17 to ON or OFF with a controller 20. In other words, an overlap amount L between an end of the cleaning member 10 and the discharge surface 51 of the recording head 1 is determined by controlling the location of the cleaning member 10, which is controlled by controlling the changeable shape of the shape memory alloy 16 by heat from the heat source instead of the rotary cam 13 in FIGS. 3A to 3D. In this way, a contact pressure (a contact load) between the cleaning member 10 and the recording head 1 during cleaning is controlled.

Figure 5A:
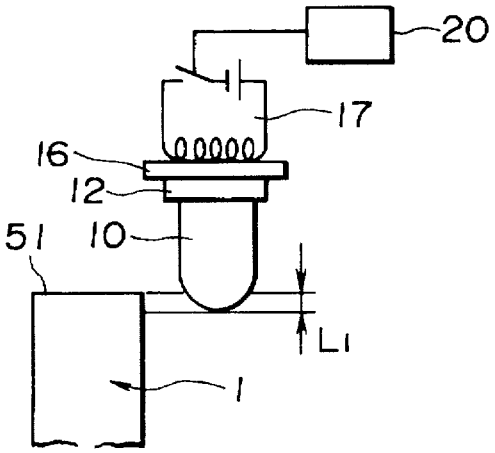
FIGS. 5A to 5D are schematic partial plan views showing a structure and movements of a cleaning means of the recovery apparatus of the ink jet recording apparatus according to a third embodiment of the present invention.
Figure 5B:
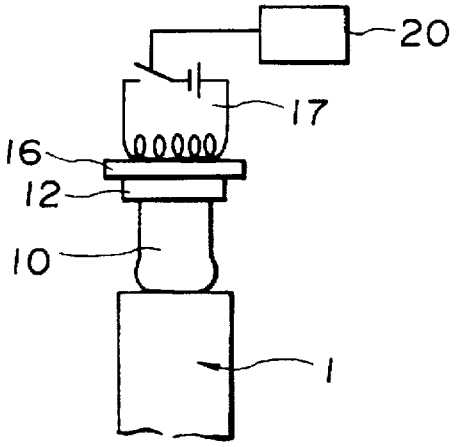

Referring to FIGS. 5A and 5B, there are shown situations in which the cleaning of the discharge surface 51 is carried out automatically after each time a preselected number of recording media are recorded upon or every preselected number of discharge signals to form droplets from the discharge openings 52 are supplied. In these situations, the heat source 17 is switched OFF, so the shape of the shape memory alloy 16 is not changed, therefore an overlap amount between an end of the cleaning member 10 and the discharge surface 51 of the recording head 1 is set to a small value $L_1$. FIG. 5A illustrates a situation in which the recording head 1 is approaching the cleaning member 10. FIG. 5B illustrates a situation in which the discharge surface 51 the cleaning member 10 and the cleaning of the discharge surface 51 is carried out.

Figure 5C:
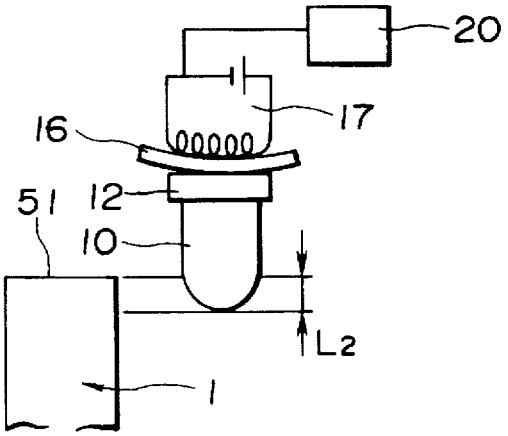
Figure 5D:
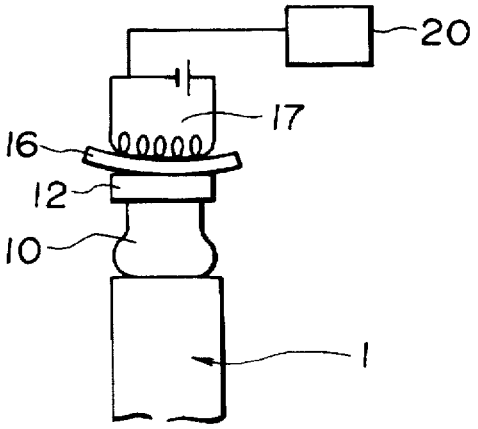

Referring to FIGS. 5C and 5D, there are shown situations in which extraneous matter (for example, extraneous matter 71 in FIG. 7) adheres to the surface 51 of the discharge openings and consequently deterioration of the recording quality occurs. In these situations, the heat source 17 is switched ON, the shape of the shape memory alloy 16 is changed to the memorized shape by the heat from the heat source and the cleaning member 10 is advanced by the change of the shape of the shape memory alloy 16. Therefore, the lap amount L is set to a large value $L_2$. Consequently, the cleaning of the discharge surface 51 by the cleaning member 10 is carried out under a larger contact pressure than in the situations of the automatic cleaning. FIG. 5C illustrates a situation in which the recording head 1 is approaching the cleaning member 10. FIG. 5D illustrates a situation in which the discharge surface 51 contacts the cleaning member 10 and the cleaning of the surface 51 of the discharge openings is carried out.

Also in this embodiment, a contact load of the cleaning member 10 is relatively small and an impact upon the contact is relatively low because the lap amount is relatively small in FIG. 5B as compared with that in FIG. 5D. Therefore, even if the cleaning of the surface 51 is carried out automatically after recording of every predetermined number of recording media or after supplying every preselected number of discharge signals, a durability of the cleaning member 10 is not adversely affected. And even if the number of cleanings of the discharge surface 51 per unit time is increased, a life of the cleaning member 10 is not adversely affected. Therefore, also according to the third embodiment as illustrated in FIGS. 5A to 5D, similar effects can be achieved as in the case of the embodiment as illustrated in FIGS. 3A to 3D.

In each of the foregoing embodiments, there has been described the case in which the cleaning member is located at a predetermined position in the ink jet recording apparatus and the cleaning of the discharge surface is carried out by utilizing the movement of the recording head. But the cleaning of the surface can be carried out by utilizing the movement of the cleaning member instead.

FIG. 6 is a table showing results of tests of recording quality, three of which are in cases in which recovery according to the first to the third embodiments described above were carried out during recording, and the other one of which is in the case in which recovery according to a conventional apparatus and method was carried out during recording as a comparative example. In these tests, changes of the recording quality after recording of every predetermined number of recording media were judged. As a recording pattern in these tests, 1500 characters were recorded on each cut sheet of A4 size paper and $1.0\times10^4$ droplets on average were discharged from one discharge opening to the cut sheet of paper.

In FIG. 6, "NUMBER OF CONTACTS N" refers to a sum of a number of contacts (a number of cleanings) using the cleaning member 10 on the discharge surface 51. "LOW LOAD $N_1$" refers to a number of contacts in which cleanings of lower contact pressure were carried out automatically after recording on every preselected number of recording media. "USUAL LOAD $N_2$" refers to a number of contacts in which cleanings of relatively high pressure were carried out in case extraneous matter likely adhered to the surface of the discharge openings.

Also in FIG. 6, "○", "Δ" and "X" represent results of tests of recording quality which 50 persons judged. "○" means a judgment of good recording quality; "Δ" means a judgment of a tendency of deterioration of recording quality by a little change of a discharge direction of a droplet from a regular direction; and "X" means a judgment of a clear tendency of deterioration of recording quality evidenced by a relatively large change of a direction of a droplet from a regular direction, that is, an occurrence of unreadable characters. Each number appended to a lower right side of each judgment mark means a number of persons (of a total of 50) who agreed with that particular judgment mark.

In the testing of the first embodiment (system shown in FIGS. 3A–3D) shown in FIG. 6, the cleaning with lower contact load than usual recovery was automatically carried out after every 100 cut sheets of recording media of A4 size were recorded. The number $N_1$ of this cleaning was 300. The cleaning (usual cleaning) of relatively high pressure (relatively high load) was carried out in the case extraneous matter probably adhered to the surface of the discharge openings because deterioration of recording quality appeared. The number $N_2$ of this cleaning was 15.

In the testing of the second embodiment (system shown in FIGS. 4A–4D) shown in FIG. 6, the cleaning with lower contact load than usual recovery was automatically carried out every time the power source for the recording apparatus was turned on. The number $N_1$ of this cleaning was 600. The cleaning (usual cleaning) at relatively high pressure (relatively high load) was carried out in the case extraneous matter probably adhered to the surface of the discharge openings because deterioration of recording quality appeared. The number $N_2$ of this cleaning was 5.

In the testing of the third embodiment (system shown in FIGS. 5A–5D) shown in FIG. 6, the cleaning with lower contact load than usual recovery was automatically carried out after every one cut sheet of recording medium of A4 size was recorded. The number $N_1$ of this cleaning was 30,000. The cleaning (usual cleaning) at relatively high pressure (relatively high load) was carried out in the case extraneous matter probably adhered to the surface of the discharge openings because deterioration of recording quality appeared. The number $N_2$ of this cleaning was 1.

In the comparative example in FIG. 6, the cleaning (usual cleaning) at relatively high pressure (relatively high load) was carried out using the conventional system only in the case where extraneous matter probably adhered to the surface of the discharge openings because deterioration of recording quality appeared. The number $N_2$ of this cleaning was 100.

In each test, the recording in which 1500 characters were recorded to one cut sheet of paper in size of A4 was continued until 30,000 total sheets of recording papers were recorded. The judgements of recording quality were carried out as panel tests in which the 50 persons judged every 5000th recorded recording sheet. Consequently, as shown clearly in FIG. 6, in the first to the third embodiments according to this invention, no deterioration of recording quality appeared. This was most evident in the third embodiment, where the usual cleaning with relatively high pressure was carried out once and the cleaning with lower contact pressure than usual recovery pressure was carried out 30,000 times, and no damage of the surface of the cleaning member appeared. As is clear from the first embodiment test results, the number of usual cleanings at relatively high pressure could be reduced to one-hundredth of those used in the third embodiment as compared with the comparative example using the conventional apparatus and method.

FIGS. 12A to 12D are schematic partial plan views showing a structure and movements of a cleaning means of the recovery apparatus of the ink jet recording apparatus according to the fourth embodiment of this invention. The differences between this embodiment and the foregoing first embodiment are as follows. As illustrated in FIGS. 12A to 12D, a cleaning member 10 is fixed at a certain position in the ink jet apparatus and a rear surface of the recording head 1 is in contact with a peripheral surface (a cam surface) of a rotary cam 13A. An overlap amount L between an end of the cleaning member 10 and the discharge surface 51 of the recording head 1 is controlled by controlling a rotating position of the rotary cam 13A with a controller 18A. In this way, a contact pressure (a contact load) between the cleaning member and the recording head during cleaning is controllable. Also in this embodiment, similar effects to those of the first embodiment shown in the Table of FIG. 6 can be obtained. Of course, the rotary cam **13*a* could also be replaced with a solenoid or a shape memory alloy as shown in FIGS. 4A–4D and 5A–5D**, respectively.

As other embodiments, both the cleaning member and the recording head may be moved by cams (or solenoids or shape memory alloys) to make high pressure contact with each other. Also in this embodiment, similar effects to those of the foregoing embodiments can be obtained.

In each of the described embodiments, the overlap amount L is increased from $L_1$ to $L_2$ when deterioration of the recording quality occurs. Recording quality deterioration often is a result of extraneous matter adhering to the discharge surface. Whether extraneous matter has adhered to the discharge surface, that is, whether recording quality deterioration has occurred, can be judged by an operator of the recording apparatus. For example, the operator can visually inspect the recording head and check for such extraneous matter. Alternately, the operator can visually determine whether the trajectory of the discharged ink droplets is improper. Further, the operator can view the recorded recording medium and determine whether characters or images are improperly formed.

As an alternative, any well-known devices can be used to determine whether extraneous matter adheres to the discharge surface by determining whether the ink droplet trajectory is improper, or whether recorded characters and images are improperly formed. After it is determined that extraneous matter likely adheres to the discharge surface and is affecting the recording quality, the rotary cam, solenoid or shape memory alloy is controlled to change the overlap amount from $L_1$ to $L_2$.

The present invention is particularly suitably useful in an ink jet recording head and recording apparatus of the type which discharges an ink by making use of thermal energy. This is because high density of picture elements and high resolution of recording are possible.

The typical structure and the operational principle are disclosed in U.S. Pat. Nos. 4,723,129 and 4,740,796. The principle is applicable to a so-called on-demand type recording system and a continuous type recording system. Particularly, however, it is suitable for the on-demand type because the principle is such that a least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as that disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Laid-Open (Kokai) No. 59-123670 wherein a common slit is used as the ejection outlet for plural electrothermal transducers, and to the structure disclosed in Japanese Patent Laid-Open (Kokai) No. 59-138461 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and an additional heating element and means for preliminary ejection not for the recording operation, which can stabilize the recording operation.

As regards the kinds of the recording head mountable, it may be a single head corresponding to a single color ink, or may be plural heads corresponding to a plurality of ink materials having different recording colors or densities. The present invention is effectively applicable to an apparatus having at least one of a monochromatic mode for recording mainly with black ink material and a multi-color mode for recording with a mixture of the colors and may be an integrally formed recording unit or a combination of plural recording heads.

Furthermore, in the foregoing embodiments, the ink material has been liquid. It may be, however, an ink material that solidifies at or below room temperature and liquefies at room temperature. Since in the ink jet recording system the ink is controlled within a temperature range not lower than 30° C. and not higher that 70° C. to stabilize the viscosity of the ink to ensure stabilized ejection, in usual recording apparatuses of this type, the ink is such that it is liquid within the temperature range when the recording signal is applied. In addition, a temperature rise due to the thermal energy may be positively prevented by utilizing the thermal energy for the state change of the ink from the solid state to the liquid state, or the ink material solidifying when it is left unused may be used to prevent the evaporation of the ink. In either case, upon the application of the recording signal producing thermal energy, the ink may be liquefied, and the liquefied ink may be ejected. The ink may start to solidify at the time it reaches the recording medium. The present invention is applicable to such an ink material as is liquefied by the application of the thermal energy. Such an ink material may be retained as a liquid Or solid material in through holes or recesses formed in a porous sheet as disclosed in Japanese Patent Laid-Open (Kokai) Nos. 54-56847 and 60-71260. The sheet is disposed facing the electrothermal transducers. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet apparatus for use with an ink jet head having a discharge surface provided with at least one of a discharge opening for discharging an ink therethrough, said apparatus comprising:

a cleaning member for making contact with the discharge surface to clean the discharge surface upon relative movement between the ink jet head and said cleaning member; and changing means for changing a first contact pressure to a second contact pressure between said cleaning member and the discharge surface in accordance with a discharging condition of the ink discharged from the discharge opening, said first contact pressure being such that a load for cleaning is 50–200 g/line of the discharge openings, and said second contact pressure being such that the load for cleaning is 200–500 g/line of the discharge openings.

2. An ink jet apparatus according to claim 1, wherein said ink jet head includes an electrothermal converting body which generates thermal energy to discharge the ink from the discharge opening.

3. An ink jet apparatus according to claim 1, further comprising control means for controlling the cleaning member so that the cleaning member is automatically caused to contact the discharge surface each time a predetermined number of recording media have been recorded.

4. An ink jet apparatus according to claim 1, further comprising control means for controlling the cleaning member so that the cleaning member is automatically caused to contact the discharge surface each time a predetermined number of discharge signals have been applied to the ink jet head.

5. A recovery method for an ink jet apparatus, which includes an ink jet head having a discharge surface provided with a discharge opening for discharging ink therethrough and a cleaning member that makes wiping contact with the discharge surface for cleaning by wiping the discharge surface upon a relative movement between the ink jet head and the cleaning member, said recovery method comprising the steps of:

effecting a first wiping under a first contact pressure between the cleaning member and the discharge surface, said first contact pressure being such that an ordinary load for cleaning is 50–200 g/line of discharge openings; and effecting a second wiping under a second contact pressure, higher than the first contact pressure, between the cleaning member and the discharge surface, in a case where a discharging condition of ink discharging from the discharge opening has deteriorated, said second contact pressure being such that a load for vigorous cleaning is 200–500 g/line of discharge openings.

6. A recovery method according to claim 5, wherein said first wiping step is automatically executed after each time a predetermined number of recording media have been recorded.

7. A recovery method according to claim 5, wherein said first wiping step is automatically executed after each time a predetermined number of discharge signals have been applied to the ink jet head.

8. A recovery method for an ink jet apparatus, which includes an ink jet head having a discharge surface provided with a discharge opening for discharging ink therethrough and onto a recording medium, an auxiliary wiping member and a cleaning member that makes contact with the discharge surface for cleaning by wiping the discharge surface upon a relative movement between the ink jet head and the cleaning member, said recovery method comprising the steps of:

effecting a first wiping under a first contact pressure between the cleaning member and the discharge surface, said first contact pressure being such that an ordinary load for cleaning is 50–200 g/line of discharge openings; and effecting a second wiping under a second contact pressure, higher than the first contact pressure, between the cleaning member and the discharge surface, in a case where a recording condition of ink discharged onto the recording medium has deteriorated, said second contact pressure being such that a load for vigorous cleaning is 200–500 g/line of discharge openings, wherein the contact pressures for said cleaning member are changed independently of a contact pressure for said auxiliary wiping member, and wherein an operator initiates said second wiping step in accordance with the deteriorated discharging condition.

9. A recovery method according to claim 8, wherein said first wiping step is automatically executed after each time a predetermined number of recording media have been recorded.

10. A recovery method according to claim 8, wherein said first wiping step is automatically executed after each time a predetermined number of discharge signals have been applied to the ink jet head.

11. A recovery method according to claim 8, wherein the deteriorated recording condition includes improperly formed characters.

12. A recovery method according to claim 8, wherein the deteriorated recording condition includes an improperly formed image.

* * * * *

UNITED STATES PATENT AND TRADEMARK OFFICE

CERTIFICATE OF CORRECTION

PATENT NO. : 5,724,078

DATED : March 3, 1998

INVENTOR(S) : YASUO KOTAKI

It is certified that error appears in the above-identified patent and that said Letters Patent is hereby corrected as shown below:

COLUMN 4

Line 19, "is a" should read --is an--.

COLUMN 6

Line 11, "opening." should read --openings.--.

COLUMN 7

Line 15, "a" should read --an--.

Line 16, "the" should read --of the--.

COLUMN 9

Line 46, "achieved to " should read -- achieved --.

COLUMN 12

Line 31, "As other" should read --As with other--.

COLUMN 13

Line 3, "a least" should read --at least--.

UNITED STATES PATENT AND TRADEMARK OFFICE

CERTIFICATE OF CORRECTION

PATENT NO. : 5,724,078

DATED : March 3, 1998

INVENTOR(S) : YASUO KOTAKI

It is certified that error appears in the above-identified patent and that said Letters Patent is hereby corrected as shown below:

COLUMN 14

Line 9, "that" should read --than--.

Line 24, "Or" should read --or--.

Signed and Sealed this

Fourteenth Day of July, 1998

Bruce Lehman

*Attest:*

BRUCE LEHMAN

*Attesting Officer*

*Commissioner of Patents and Trademarks*